US007857380B2

(12) United States Patent
Grieger et al.

(10) Patent No.: US 7,857,380 B2
(45) Date of Patent: Dec. 28, 2010

(54) PORTABLE MULTIFUNCTIONAL CHAIR

(76) Inventors: Mark A. Grieger, 4115 W. Jefferson Blvd., Fort Wayne, IN (US) 46804; Patrick J. Sommer, 10826 Tradewinds Ct., Fort Wayne, IN (US) 46825; Kim A. Goneau, 10822 Tradewinds Ct., Fort Wayne, IN (US) 46825

( * ) Notice: Subject to any disclaimer, the term of this patent is extended or adjusted under 35 U.S.C. 154(b) by 257 days.

(21) Appl. No.: 12/106,093

(22) Filed: Apr. 18, 2008

(65) Prior Publication Data

US 2009/0026810 A1 Jan. 29, 2009

Related U.S. Application Data

(60) Provisional application No. 60/913,225, filed on Apr. 20, 2007.

(51) Int. Cl.
*A47C 7/62* (2006.01)
*A47C 4/28* (2006.01)

(52) U.S. Cl. ..... 297/188.1; 297/45; 297/DIG. 6

(58) Field of Classification Search ..... 4/484, 4/460, 234; 297/182, 188.09, 188.1, 45, 297/452.22, 331, 335, 16.1, 17
See application file for complete search history.

(56) References Cited

U.S. PATENT DOCUMENTS

| | | | | |
|---|---|---|---|---|
| 1,521,740 | A * | 1/1925 | Wernli et al. | 4/484 |
| 5,709,428 | A * | 1/1998 | Hugghins | 297/16.2 |
| 6,082,813 | A * | 7/2000 | Chen | 297/16.2 |
| 6,647,560 | B1 * | 11/2003 | Hingley et al. | 4/484 |
| 6,889,393 | B1 * | 5/2005 | Rinaldo | 4/484 |
| 6,899,383 | B2 * | 5/2005 | Hwang | 297/16.2 |
| D531,825 | S * | 11/2006 | Jenkins et al. | D6/335 |
| 7,260,855 | B2 * | 8/2007 | Aycock | 4/484 |

* cited by examiner

*Primary Examiner*—Milton Nelson, Jr.
(74) *Attorney, Agent, or Firm*—Robert Iannucci; Seed IP Law Group PLLC

(57) ABSTRACT

A portable chair is configurable to serve various utilitarian needs. In one embodiment, the portable multifunctional chair includes a frame, a seat attached to the frame and an adjustable seat flap fixed to the seat. The seat has an inner edge that encloses a seat opening. The adjustable seat flap is approximately flush with the seat when the seat flap is secured to the seat in a closed position in which the seat flap covers the opening. The multifunctional chair has at least one transverse dimension that is less than 25% of the longitudinal length when the multifunctional chair is configured in a portable state.

14 Claims, 9 Drawing Sheets

PORTABLE MULTIFUNCTIONAL CHAIR

CROSS-REFERENCE TO RELATED APPLICATION

This application claims the benefit under 35 U.S.C. §119 (e) of U.S. Provisional Patent Application No. 60/913,225, filed Apr. 20, 2007, is incorporated herein by reference in its entirety.

BACKGROUND

1. Technical Field

This invention relates generally to outdoor activities and more particularly to a multifunctional portable chair.

2. Description of the Related Art

There exist many types of portable chairs that serve a variety of functions. Portable chairs are manufactured for fisherman, hunters, campers, and hikers. These chairs may have accessories that accommodate various needs associated with such activities. For example, a portable hunting or fishing chair may include pouches, straps, or other accessories that add to the utility of the chair. A portable chair used for recreational purposes may have cup holders and retractable arm rests.

Occasionally, outdoor enthusiasts need to address bodily functions away from the conveniences afforded by sanitary facilities. Since the dawn of time, humans have responded to biological necessity by squatting and depositing. This type of activity not only places undue stress on a person's knees, lower back, and other joints and muscles, but requires in some cases a balancing act in which failure is not an option.

It would be desirable to have a device that addresses space and weight concerns of the typical outdoor enthusiast, serves the user in a multifunctional capacity, and alleviates conventional inconveniences of making a biological deposit in the great outdoors.

BRIEF SUMMARY

The invention provides a portable chair configurable to serve various utilitarian needs. In one embodiment, the portable multifunctional chair includes a frame, a seat attached to the frame and an adjustable seat flap having a first surface, a second surface, an anterior portion and a posterior portion. The posterior portion is permanently fixed to the seat. Furthermore, the seat has an inner edge that encloses a seat opening.

In another embodiment, the portable multifunctional chair further includes a seat back attached to the frame and the seat. The seat back includes a seat back tab. In yet another embodiment, the seat flap includes a seat flap tab for interlocking with the seat back tab to secure the seat flap in an open position.

In another embodiment, the seat includes a seat locking strip attached adjacent to the inner edge of the seat. In one embodiment, the seat flap includes a seat flap locking strip attached to the second surface of the seat flap for interlocking with the seat locking strip to secure the seat flap to the seat in a closed position.

In one embodiment, the portable multifunctional chair has at least one transverse length that is less than 25% of a longitudinal length when the multifunctional chair is portably configured.

In yet another embodiment, the adjustable seat flap extends less than one quarter of an inch above the seat when the seat flap is secured to the seat in a closed position.

DETAILED DESCRIPTION

Figure 1:
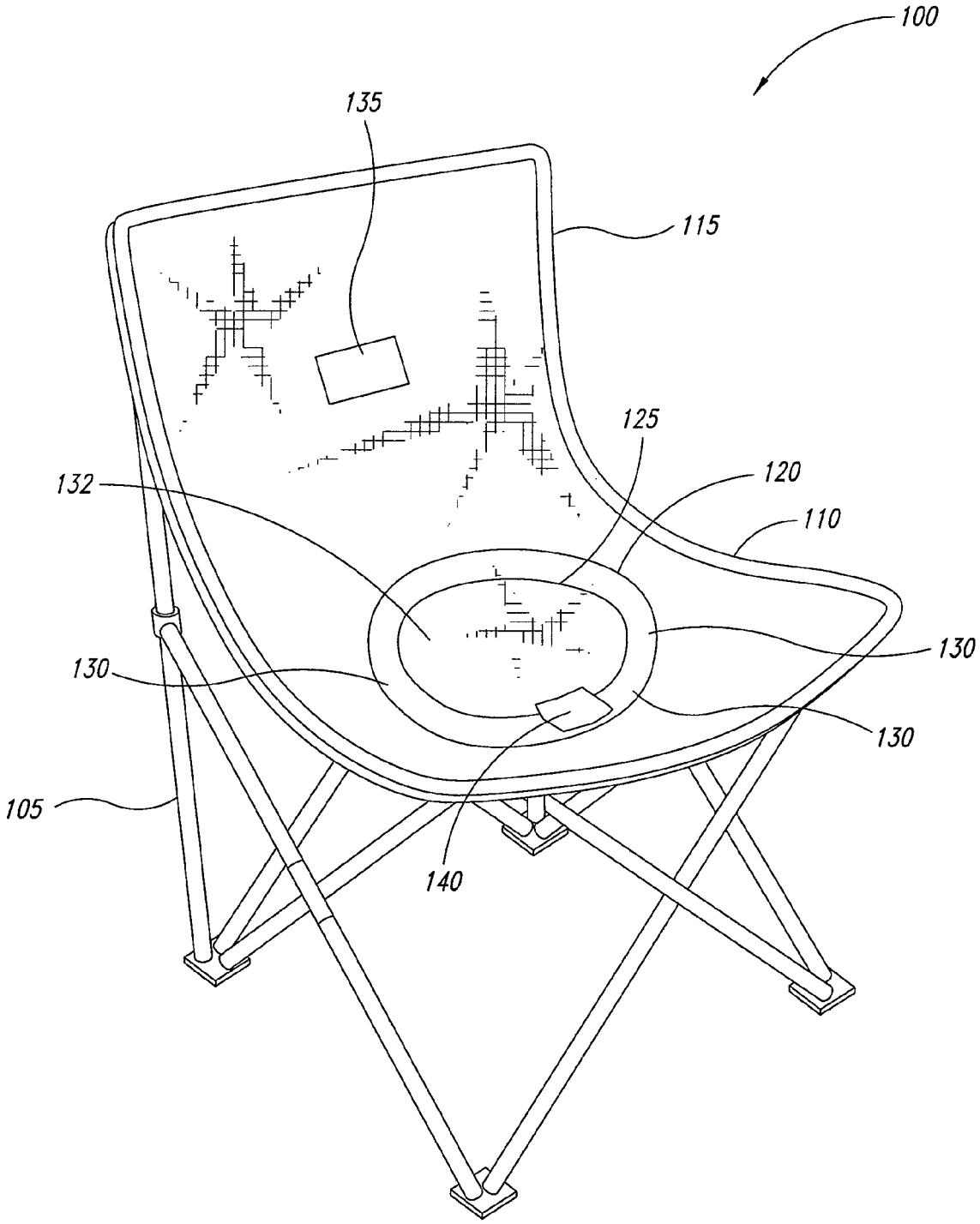
FIG. 1 is an anterior isometric view of a portable multifunctional chair in a closed-seat functional configuration, according to one embodiment of the invention.
Figure 2:
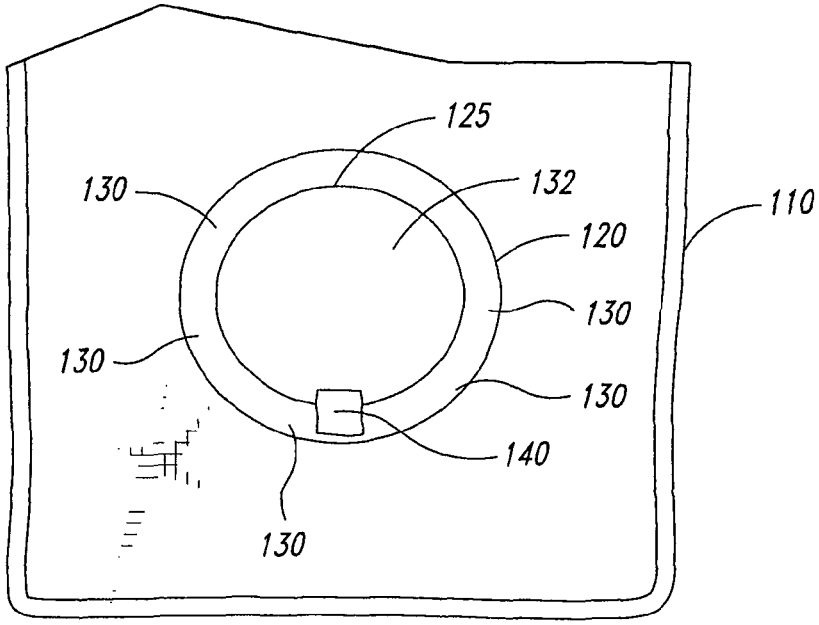
FIG. 2 is an overhead isometric view of the portable multifunctional chair illustrated in FIG. 1.

FIG. 1 is an anterior isometric view of a portable multifunctional chair 100 in a closed-seat functional configuration, according to one embodiment of the invention. The multifunctional chair 100 comprises a frame 105, a seat 110, a seat back 115 and an adjustable seat flap 120. The adjustable seat flap 120 includes a posterior portion 125, an anterior portion 130, and a first surface 132. In addition, the seat back 115 includes a seat back tab 135. FIG. 2 is an overhead isometric view of the portable multifunctional chair 100 illustrated in FIG. 1. As illustrated, the adjustable seat flap 120 includes a seat flap tab 140.

As illustrated in FIG. 1 and FIG. 2, the adjustable seat flap 120 is secured to the seat 110 in a closed position. In operation, a user may advantageously secure the adjustable seat flap 120 in one of two positions (i.e., closed or open). In one embodiment, the posterior portion 125 of the adjustable seat flap 120 is permanently and rotatably fixed to the seat 110, while the anterior portion 130 is removably fixed to the seat 110. For example, a user may apply a force to the adjustable seat flap 120 to disengage the anterior portion 130 of the adjustable seat flap 120 from the seat 110, thus rotating the adjustable seat flap 120 about the posterior portion 125 that is permanently fixed to the seat 110. Upon lifting the adjustable seat flap 120, a user may secure the adjustable seat flap 120 in an open position by engaging the seat flap tab 140 with the seat back tab 135.

In one embodiment of the invention, the seat back tab 135 and the seat flap tab 140 are hook and loop tabs, such as Velcro™ tabs. The user may secure the adjustable seat flap 120 in the open position by interlocking the Velcro™ seat flap tab 140 with the Velcro™ seat back tab 135. However, the scope of the present invention includes other means know in the art for removably securing two pieces of fabric together.

In one embodiment of the invention, the frame 105 is composed of metal rods. However the scope of the present invention covers all types of portable chair frames, including plastic and wood, for example. The frame 105 may be of a conventional tubular design, configured to fold together for portability. For example, the frame 105 may be composed of rods that are attached to one another via fastening devices that allow the rods to rotate and translate with respect to each other when the portable multifunctional chair 100 is placed into a portable configuration. The portable configuration of the multifunctional chair 100 will be discussed further below in conjunction with FIG. 5. The seat 110, the seat back 115 and the adjustable seat flap 120 may be constructed of canvas or vinyl. In other embodiments of the invention, the seat 110, the seat back 115 and the adjustable seat flap 120 may be constructed of any durable and preferably water resistant material, such as plastic, for example.

Figure 3:
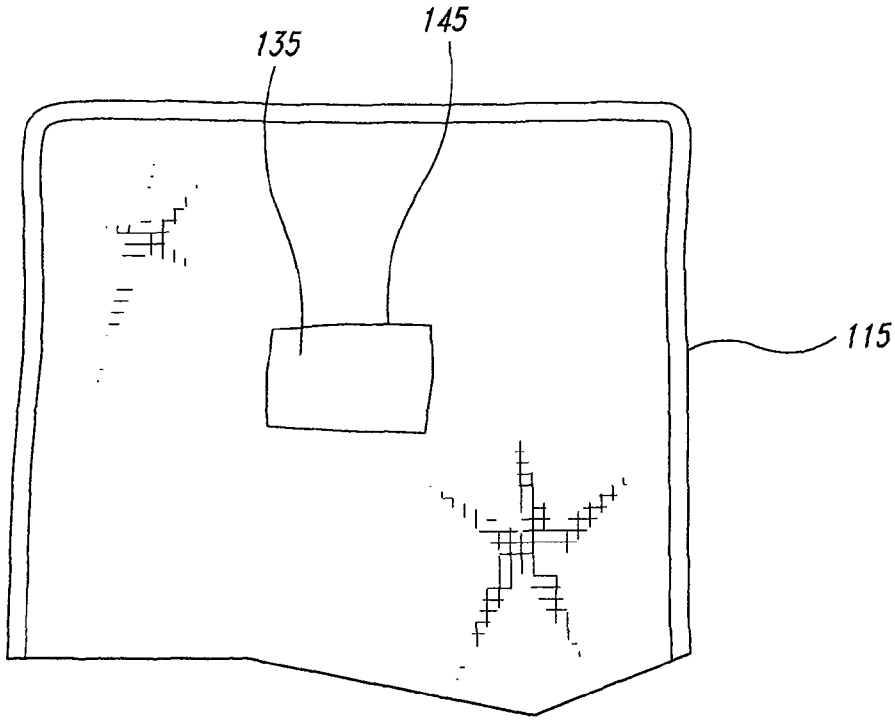
FIG. 3 is an anterior isometric view of the seat back of the portable multifunctional chair illustrated in FIG. 1, according to one embodiment of the invention.

FIG. 3 is an anterior isometric view of the seat back 115 of the portable multifunctional chair 100 illustrated in FIG. 1, according to one embodiment of the invention. As illustrated, the seat back tab 135 is sewn to the seat back 115 via a stitching line 145. However, the scope of the present invention covers all other types of conventional methods for permanently securing two pieces of fabric to each other.

Figure 4:
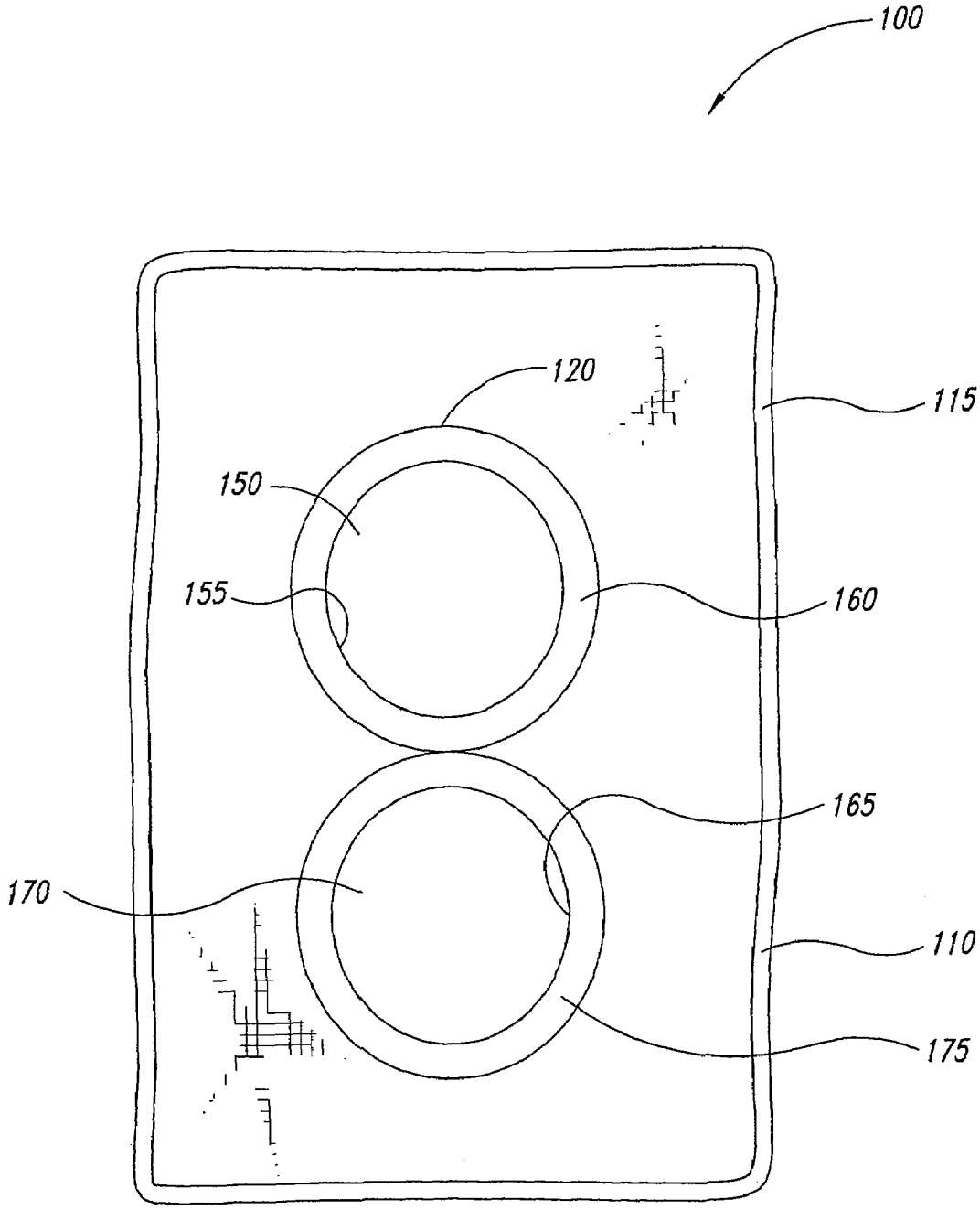
FIG. 4 is an overhead isometric view of an open-seat functional configuration of the portable multifunctional chair illustrated in FIG. 1, according to one embodiment of the invention.

FIG. 4 is an overhead isometric view of the portable multifunctional chair 100 in an open-seat functional configuration, according to one embodiment of the invention. As illustrated, the seat flap tab 140 (FIG. 2) is engaged with the seat back tab 135 (FIG. 1) to secure the adjustable seat flap 120 in an open position. The seat flap 120 includes a second surface 150 having an outside circumferential portion 155 and a seat flap locking strip 160. The seat flap locking strip 160 is fastened to the outside circumferential portion 155 of the second surface 150 of the seat flap 120.

The seat 110 includes an inner edge 165 that encloses a seat opening 170 located in a central portion of the seat 110. In addition, the seat 110 includes a seat locking strip 175. The seat locking strip 175 is fastened to the seat 110 adjacent to the inner edge 165. The seat locking strip 175 is fastened to the seat 110 via any conventional means of permanently securing two pieces of natural or artificial fabric or other types of material, such as plastic for example.

In one embodiment of the invention, the seat flap locking strip 160 engages the seat locking strip 175 to secure the adjustable seat flap 120 to the seat 110 in a closed position (FIG. 1). In one embodiment of the invention, the strips are composed of Velcro™. However, strips composed of natural fabrics, artificial fabrics, plastics or any combination of these or other fastening means are within the scope of the present invention.

The adjustable seat flap 120 may be secured in one of two positions. When a user rotates the adjustable seat flap 120 from an open position (FIG. 4) to a closed position (FIG. 1) about the posterior portion 125 that is permanently fixed to the seat 110, the seat flap locking strip 160 interlocks with the seat locking strip 175, and the chair 100 is enabled to be used as a conventional chair. However, if the user wishes to use the portable multifunctional chair 100 as a portable toilet, the user applies a force to the adjustable seat flap 120 to disengage the seat flap locking strip 160 from the seat locking strip 175. The user then lifts the adjustable seat flap 120 (i.e., rotates the adjustable seat flap 120 about the posterior portion 125 that is permanently fixed to the seat 110) such that the seat flap tab 140 interlocks with the seat back tab 135, thus securing the adjustable seat flap 120 in an open position. The user may now utilize the portable multifunctional chair 100 as a toilet.

Figure 5:
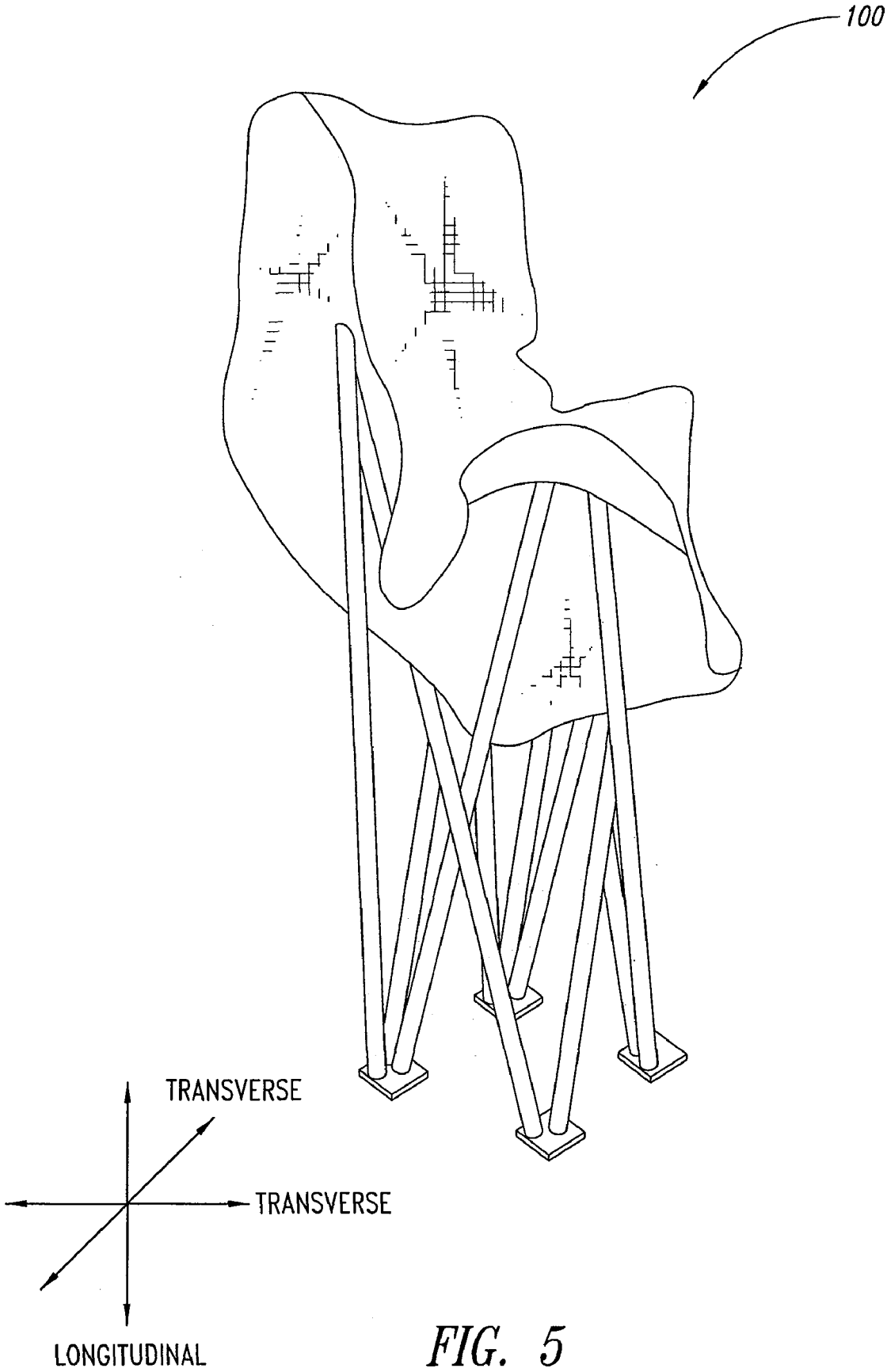
FIG. 5 is an isometric view of a portable configuration of the portable multifunctional chair illustrated in FIG. 1, according to one embodiment of the invention.

FIG. 5 illustrates the portable multifunctional chair 100 in a portable configuration, according to one embodiment of the present invention. As illustrated, the portable multifunctional chair 100 may be folded to facilitate portability and ease of storage. In one embodiment, the portably configured multifunctional chair 100 has a longitudinal length that exceeds one or more of the transverse lengths.

Figure 6:
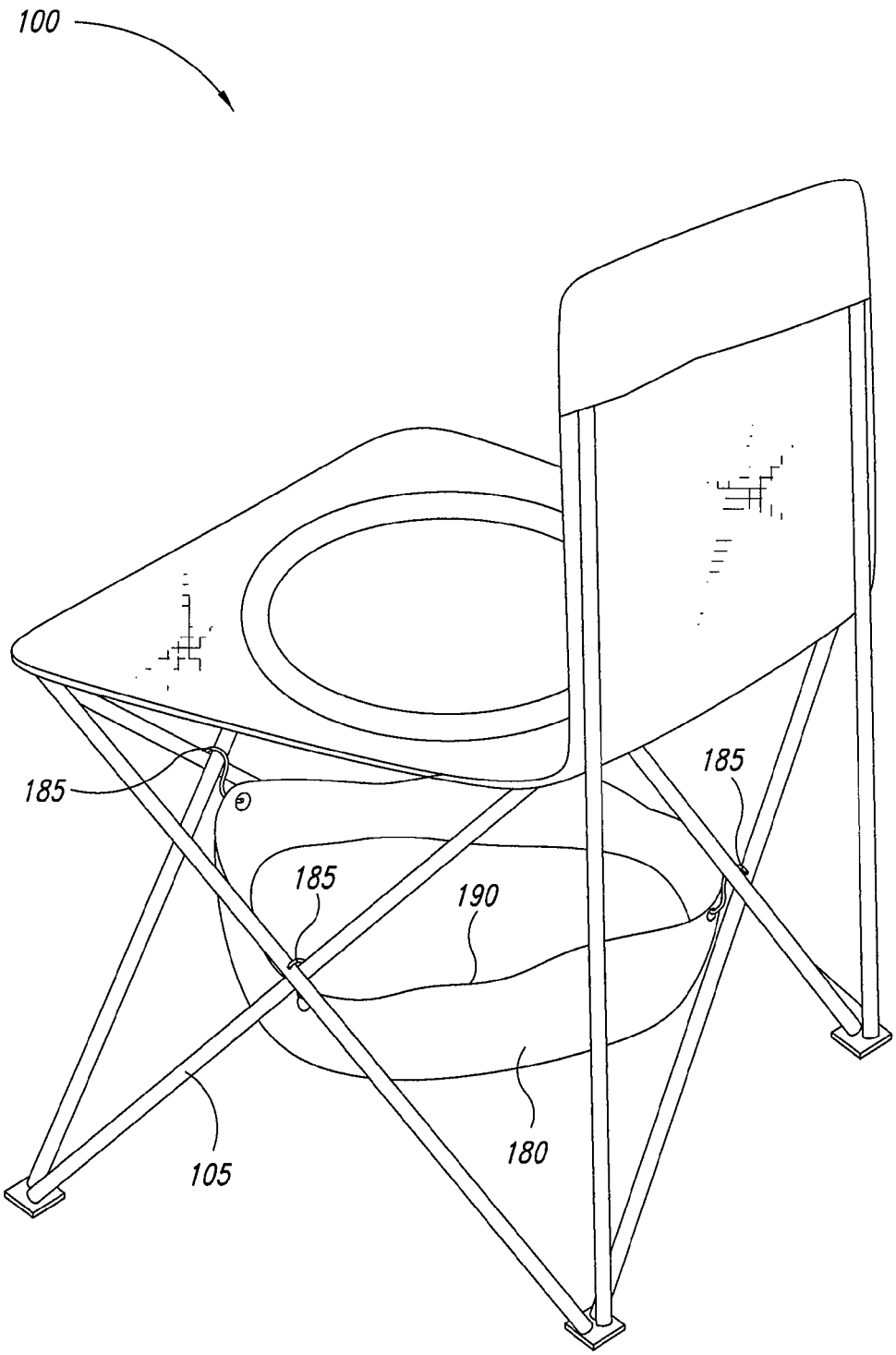
FIG. 6 is a posterior isometric view of the portable multifunctional chair illustrated in FIG. 1 with waste collection receptacle, according to one embodiment of the invention.

FIG. 6 is an isometric view of the portable multifunctional chair 100, according to another embodiment of the invention. The portable multifunctional chair 100 includes a waste collection receptacle 180. As illustrated, the waste collection receptacle 180 is removably attached to the frame 105. In one embodiment, spring fasteners 185 connect the waste collection receptacle 180 to the frame 105 at two or more fastening sites. In another embodiment, the waste collection receptacle 180 includes a locking ring (not shown) fastened along an upper edge 190 of the receptacle 180. In operation, the locking ring interlocks with the seat locking strip 175 (FIG. 4) to secure the waste collection receptacle 180 to the seat 110. Waste flowing through the seat opening 170 (FIG. 4) is deposited directly into the waste collection receptacle 180. The user may then detach the waste collection receptacle 180 from the seat 110 by applying a force to separate the locking ring of the waste collection receptacle 180 from the seat locking strip 175. In one embodiment, the locking ring is a Velcro™ strip.

In another embodiment, the waste collection receptacle 180 is a plastic bag having a locking strip mounted around a perimeter of an open end of the bag for attaching the waste collection receptacle 180 to the seat locking strip 175 of the seat 110. In yet another embodiment, the waste collection receptacle 180 is a plastic bag that is inserted through the seat opening 170. A portion of an open end of the bag rests upon the seat 110. A portion of the closed end of the bag may be supported by any surface upon which the chair 100 sits.

Figure 7:
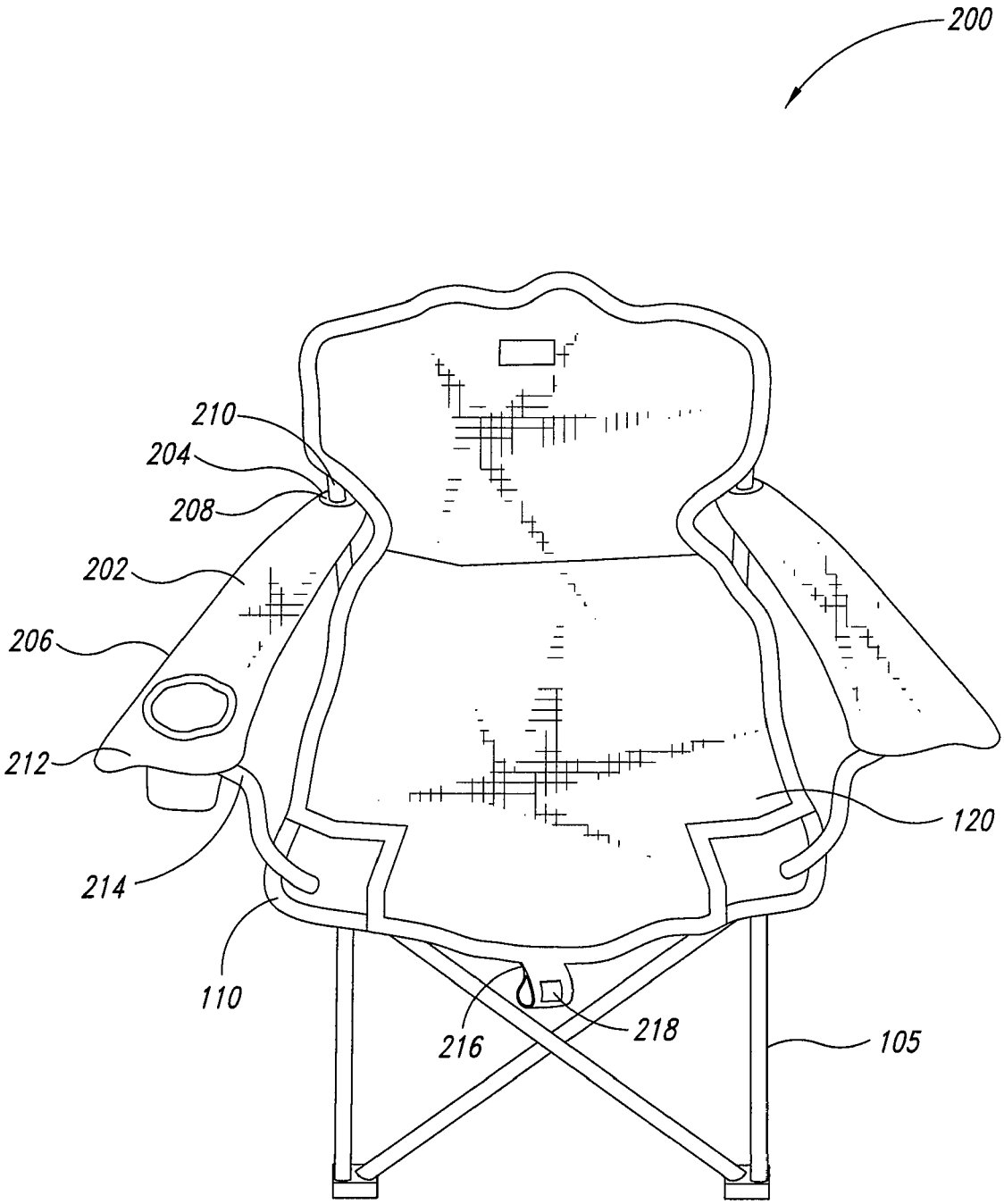
FIG. 7 is an anterior isometric view of a portable multifunctional chair in a closed-seat functional configuration, according to another embodiment of the invention.

FIG. 7 is an anterior isometric view of a portable multifunctional chair 200 in a closed-seat functional configuration, according to another embodiment of the invention. As illustrated, the multifunctional chair 200 includes an arm 202 having a posterior portion 204 and an anterior portion 206. In one embodiment, the posterior portion 204 of the arm 202 includes a grommet 208 for securing the posterior portion 204 of the arm 202 to a posterior segment of the frame 210.

In one embodiment, the anterior portion 206 of the arm 202 includes a sleeve 212. As illustrated, the sleeve 212 slips over an anterior segment of the frame 214. The sleeve 212 and the anterior segment of the frame 214 may include a snap button fastener or other fastening means to removably secure the sleeve 212 to the anterior segment of the frame 214.

In one embodiment, the portable multifunctional chair 200 includes a seat flap strap 216 attached to the adjustable seat flap 120. Furthermore, the chair 200 may include a seat strap (not shown) attached to an underside of the seat 110. A user may engage the straps to facilitate separation of the adjustable seat flap 120 from the seat 110. In one embodiment, the seat flap strap 216 may include a tab 218 for interlocking with the seat back tab 135 (FIG. 1). In an alternate embodiment, the seat back tab 135 is attached to a side of the seat back 115 (FIG. 1) facing away from the seat 110.

Figure 8:
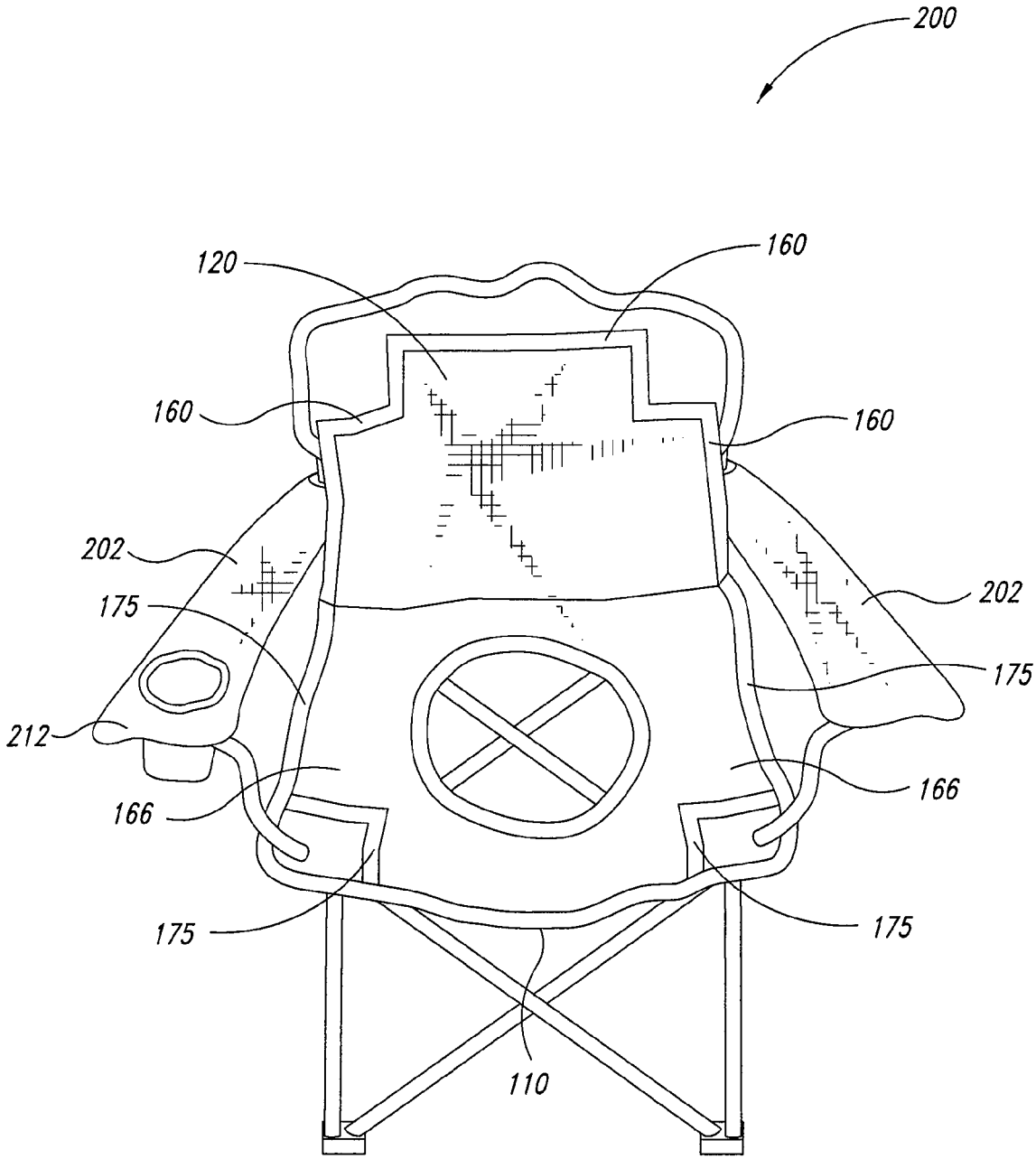
FIG. 8 is an anterior isometric view of an open-seat functional configuration of the portable multifunctional chair illustrated in FIG. 7, according to one embodiment of the invention.

FIG. 8 is an anterior isometric view of the portable multifunctional chair 200 in an open-seat functional configuration, according to one embodiment of the invention. The seat locking strip 175 is fastened to an outer portion 166 of the seat 110.

In one embodiment of the invention, the seat flap locking strip 160 engages the seat locking strip 175 to secure the adjustable seat flap 120 to the seat 110 in a closed position (FIG. 7). In one embodiment of the invention, the strips are composed of Velcro™. However, strips composed of natural fabrics, artificial fabrics, plastics or any combination of these or other fastening means are within the scope of the present invention.

Figure 9:
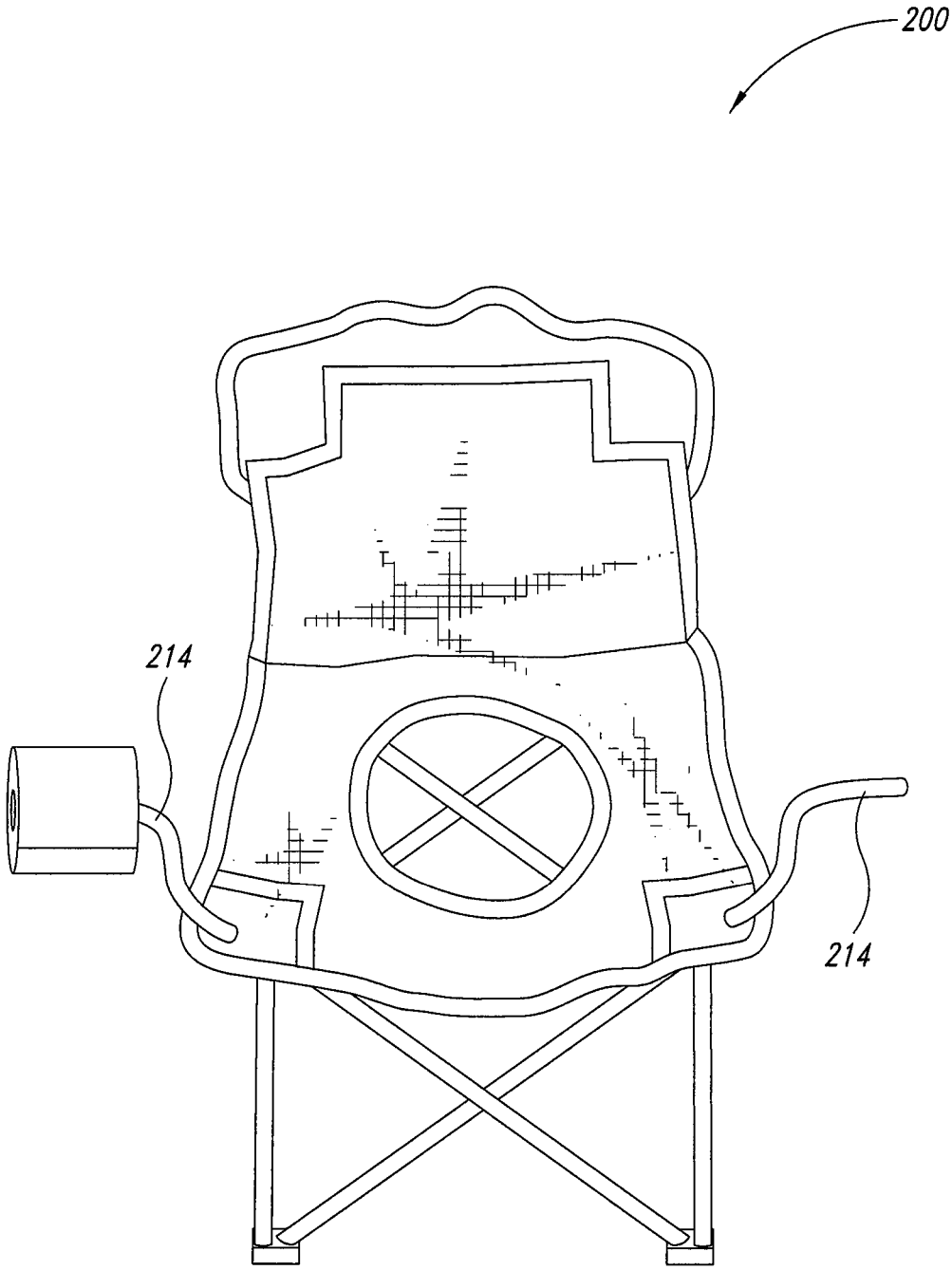
FIG. 9 is an anterior isometric view of an open-seat, arm-down functional configuration of the portable multifunctional chair illustrated in FIG. 7, according to one embodiment of the invention.

A user may remove the sleeve 212 from the anterior segment of the frame 214 to place the chair 200 in an arm-down configuration. For example, after the user makes a biological deposit, the user may wish to reconfigure the chair 200 in an arm-down configuration to facilitate the use of toilet paper. FIG. 9 is an anterior isometric view of the portable multifunctional chair 200 in an open-seat, arm-down functional configuration, according to one embodiment of the invention. As illustrated, the user may use the anterior segment of the frame 214 as a toilet roll holder by sliding a roll of toilet paper onto the anterior segment of the frame 214. In one embodiment of the invention, the arm 202 (FIG. 8) is comprised of fabric, however, the scope of the invention covers arms comprised of wood, plastic, metal, or other materials known to one of skill in the art.

Figure 10:
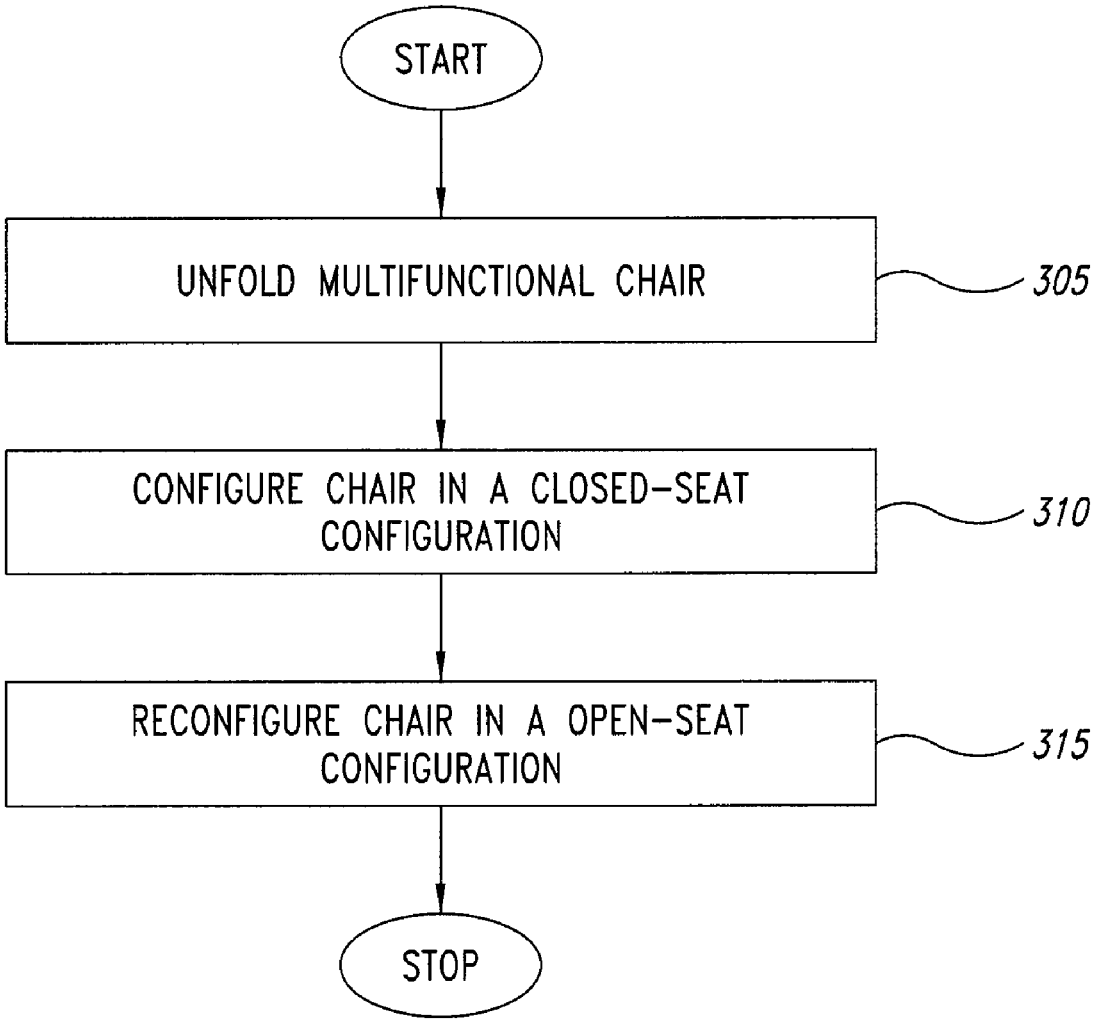
FIG. 10 is an exemplary flowchart of method steps for using the portable multifunctional chair illustrated in FIGS. 1-9.

FIG. 10 is an exemplary flowchart of method steps for using the portable multifunctional chair as illustrated in FIGS. 1-9. The method steps apply to the portable multifunctional chair 100 and 200, however, the method steps are described in conjunction with chair 100 for ease of illustration. In step 305, assuming that the chair 100 is initially portably configured (FIG. 5), the user unfolds the multifunctional chair. If a user wishes to use the chair as a means of relaxation, the user will configure the chair in a closed-seat functional configuration (FIG. 1). For example, if the adjustable seat flap 120 is not fastened to the seat 110 (i.e., the seat flap 120 is not closed), then in step 310 the user rotates the adjustable seat flap 120 about the posterior portion 125 of the seat flap 120 (that is permanently fixed to the seat 110) until the seat flap locking strip 160 (FIG. 4) interlocks with the seat locking strip 175 (FIG. 4). The user may now sit in the portable multifunctional chair 100 (FIG. 1) for purposes of relaxation or other utilitarian needs.

If the user wishes to use the portable multifunctional chair 100 (FIG. 1) as a portable toilet, the user will reconfigure the chair 100 into an open-seat configuration. For example, in step 315, the user applies force to disengage the seat flap locking strip 160 from the seat locking strip 175. The user then rotates the adjustable seat flap 120 about the posterior portion 125 of the seat flap 120 (that is permanently fixed to the seat 110) until the seat back tab 135 (FIG. 1) interlocks with the seat flap tab 140 (FIG. 2), thereby securing the adjustable seat flap 120 in an open position (FIG. 4).

The present invention has been described above with reference to exemplary embodiments. Other embodiments will be apparent to those skilled in the art in light of this disclosure. The present invention may readily be implemented using configurations other than those described in the exemplary embodiments above. Therefore, these and other variations upon the exemplary embodiments are covered by the present invention.

What is claimed is:

1. A portable multifunctional chair, comprising:

a rigid frame;

a flexible seat attached to the frame, the seat having an inner edge that encloses a seat opening;

a seat flap having an edge region fixed to the seat, the seat flap being positioned to cover the seat opening and being structured to be moved to uncover the seat opening; and a seat back attached to the frame and the seat, the seat back including a seat back tab configured to interlock with the seat flap to secure the seat flap in an open position.

2. The portable multifunctional chair of claim 1, further comprising a waste receptacle coupled to the frame and having an opening positioned directly below the seat opening.

3. The portable multifunctional chair of claim 1, wherein the seat flap includes a seat flap strap, the strap having a tab for interlocking with the seat back tab to secure the seat flap in the open position.

4. The portable multifunctional chair of claim 1, wherein the seat flap includes a seat flap tab for interlocking with the seat back tab to secure the seat flap in the open position.

5. The portable multifunctional chair of claim 4, wherein the seat flap tab and the seat back tab are hook and loop tabs.

6. The portable multifunctional chair of claim 4, wherein the seat flap tab is attached to a first surface of an anterior portion of the seat flap.

7. The portable multifunctional chair of claim 1, wherein the frame includes a plurality of legs that are hinged with respect to one another, thereby enabling the frame to be collapsed into a portable configuration.

8. The portable multifunctional chair of claim 1, wherein the seat includes a seat locking strip attached adjacent to the inner edge of the seat.

9. The portable multifunctional chair of claim 8, wherein the seat flap includes a seat flap locking strip attached to a second surface of the seat flap for interlocking with the seat locking strip to secure the seat flap to the seat in a closed position.

10. The portable multifunctional chair of claim 9, wherein the seat flap locking strip and the seat locking strip are hook and loop strips.

11. The portable multifunctional chair of claim 1, wherein the seat includes a seat locking strip attached to an outer portion of the seat.

12. The portable multifunctional chair of claim 1, wherein the multifunctional chair has at least one transverse dimension and a longitudinal length, the transverse dimension being less than 25% of the longitudinal length when the multifunctional chair is configured in a portable state.

13. The portable multifunctional chair of claim 1, wherein the seat flap extends less than one quarter of an inch above the seat when the seat flap is secured to the seat in a closed position.

14. The portable multifunctional chair of claim 1, further comprising an arm having posterior and anterior portions, the anterior portion being removably attached to the frame.

* * * * *